United States Patent [19]

Storer

[11] 4,237,663

[45] Dec. 9, 1980

[54] FALSE CEILING ACCESS PANELS

[75] Inventor: Barrie W. Storer, Nuneaton, England

[73] Assignee: Profilex Limited, Hinckley, England

[21] Appl. No.: 957,349

[22] Filed: Nov. 3, 1978

[30] Foreign Application Priority Data

Nov. 5, 1977 [GB] United Kingdom ..... 46119/77

[51] Int. Cl.[3] ..... E05D 15/10; E06B 1/12; E04B 5/52

[52] U.S. Cl. ..... 52/204; 49/209; 49/394; 52/475; 52/484

[58] Field of Search ..... 52/484, 204, 475, 476, 52/303; 49/209, 394

[56] References Cited

U.S. PATENT DOCUMENTS

| | | | |
|---|---|---|---|
| 887,470 | 5/1908 | Flagg | 52/476 |
| 2,070,150 | 2/1937 | Venzie | 52/127 |
| 2,854,706 | 10/1958 | Merlino | 52/484 X |
| 2,926,237 | 2/1960 | Sorenson | 52/484 X |
| 3,001,616 | 9/1961 | Griffin | 52/475 X |
| 3,359,695 | 12/1967 | Gazerro | 52/127 |
| 3,481,088 | 12/1969 | Lickliter et al. | 52/476 X |
| 3,714,753 | 2/1973 | Jahn | 52/484 |
| 3,828,507 | 8/1974 | Storer | 52/484 |

FOREIGN PATENT DOCUMENTS

| | | | |
|---|---|---|---|
| 29002 | 3/1904 | Switzerland | 52/204 |

*Primary Examiner*—Alfred C. Perham
*Attorney, Agent, or Firm*—Carothers and Carothers

[57] ABSTRACT

An access panel assembly for a suspended ceiling comprises one or more access panels pivotally mounted on an outer frame. The panel or panels can be raised to lie flush with the frame and with a suspended ceiling, or lowered to an access position. The pivotal mounting is provided by one or more pivot pins on the outer frame engaging guide slots in brackets on the one or more access panels. Each guide slot preferably comprises a generally horizontal portion for receiving its pivot pin when the panel is in its raised position and a portion extending downwardly and to one side of the access panel.

11 Claims, 14 Drawing Figures fig II A

FALSE CEILING ACCESS PANELS

This invention relates to access panels for ceilings, particularly for false ceiling systems in which an array of ceiling tiles, generally acoustic or sound-insulating tiles, is suspended below true ceiling height.

The ceiling tiles are mounted on a grid which is secured to a framework of carrying channels suspended below true ceiling height. The grid may be concealed or exposed to the view of persons in the room beneath, although the invention is particularly suited for use with ceiling systems in which the grid is concealed. The common concealed grid systems are the so-called "concealed Z-bar systems" and "H and T systems." In any suspended ceiling system, to provide access to the space between the grid and the true ceiling, access panels may be provided, each access panel being pivotably downwardly to an access position after releasing a catch mechanism retaining it in its normal raised position which is flush with the underside of the suspended ceiling. The access panels themselves carry one or more acoustic tiles, and as the tiles are liable to damage at their edges, the access panels generally have depending metal protecting lips all around the edge of the panel or panels. This gives the access panels appreciable thickness, and if they are to fit accurately and closely in the grid it has been thought necessary to have them hinged about the lower edge of one of the metal protecting lips. This however, is unsightly in use, as the hinge edge is exposed to view.

In this specification the terms "upper," "lower" and "horizontal" are used to refer to the normal position of the panels in use, forming part of a horizontal planar suspended ceiling.

The invention provides an access panel assembly for a ceiling, comprising a metal outer frame around at least one access panel which has a depending metal skirt around the edge thereof and which fits flush in the opening defined by the frame, a pivot rod mounted securely on the frame above the panel or panels above and parallel to, but laterally spaced from, an adjacent edge of the panel or panels, and at least two upstanding brackets on each panel, each having a guide slot therein for receiving the pivot rod, wherein each guide slot extends from a generally horizontal first end portion for receiving the rod when the access panel is raised, to a second end portion nearer the adjacent edge of the associated access panel.

As the or each access panel is lowered from its raised position to a lowered access position, the guide slots in the brackets of the access panel slide over the pivot rod simultaneously with the pivoting of the panel. As the or each access panel is pivoted downwardly to its access position the sliding of the guide slots over the pivot rod causes the edge of the access panel adjacent and parallel to the pivot rod axis to move away from the corresponding edge of the outer frame, and from any ceiling tiles mounted thereon, to prevent damage to the tile edges. The sliding of the guide slots over the rod may be a part of a single uninterrupted movement as the panel is lowered, or may take place only at one intermediate stage of opening. For example, the panel may be lowered only a few degrees, until its leading edge is below ceiling height, and then may be drawn laterally of the opening until the guide slots slide over the rod. Further lowering of the panel is then simple pivotal movement, with the rod positively located at the ends of the guide slots.

If desired a stop member, such as a further rod parallel to the pivot rod axis, may be secured to the outer frame and positioned to coact with the panel or with its brackets to provide a stop for the first degrees of movement of the panel, or to provide a stop to prevent the panel from swinging past the vertical until its underside fouls the frame. Any such stop is advantageously buffered by a resilient covering.

Advantageously the pivot rod passes through the outer frame at its ends. This enables the access panel to be removed completely by withdrawing the rod axially. If the rod is very long, as it might be for example if a number of access panels were mounted side by side and pivotable about the same rod, it may additionally be supported between its ends by brackets mounted on the metal outer frame.

If desired the outer frame may be around a pair of access panels which are pivoted about opposite parallel sides, to provide a substantial access opening when both panels are lowered. The pivot mounting of each access panel should then be the same, namely the two or more upwardly extending brackets each having a guide slot therein for receiving a pivot rod for that particular panel.

Each slot in the brackets preferably comprises a generally horizontal portion for receiving the pivot rod when the associated panel is in its raised position. The weight of the panel is then normal to the slot when the panel is raised. The slots may thereafter extend horizontally in a general direction towards the adjacent edge of the panel or panels, or may be inclined downwardly from the horizontal, in the general direction of the panel edge. Advantageously each slot extends in a smooth uninterrupted arc, centred about a common axis that is immediately beneath the axis of the pivot rod and adjacent a lower surface of the access panel.

It has been found that an access panel assembly according to the invention is considerably stronger, more reliable and more adaptable than an alternative construction in which pivot pins on the panel traverse a slot in the outer frame. It is stronger because the frame is not weakened by the formation of guide slots therein. It is more reliable because the weight of the panel causes the pivot rod to seat securely in the ends of the guide slots, giving a controlled pivotal movement of the panel in the final stages of opening. It is more adaptable because in the construction of the invention the positions of the rod and brackets can easily be varied, on site if necessary, to accommodate tiles of greater thickness.

The access panel or panels may be used to support tiles or timber cladding to match the rest of the suspended ceiling or may support a painted metal or plasterboard facing. Most frequently it will be desirable for the panel or panels to support one or more ceiling tiles, which may be secured to the panel by means of adhesive or by means of flanges of the panel engaging the conventional edge kerfs or grooves in the tiles.

If desired a gasket or seal member may be provided on the access panel or on the outer frame, to provide an airtight seal between the outer frame and panel. This enables the air space immediately above the suspended ceiling to be used as a plenum chamber for a ventilation system. Even for normal installations, however, when the air space above the suspended ceiling is at the same pressure as that below, the use of the above gasket or seal is desirable because it avoids the formation of air currents through the crack between the frame and the panels. Such air movement carries dust with it and causes discolouration of the tile edges.

The assembly is preferably provided with a latch or bolt for retaining the tile support panel in its raised position. The latch or bolt may be mounted on the panel or on the frame, but is preferably on the frame so that the top surface of the panel is smooth and flush. This avoids damage to adjacent ceiling tiles as the panel is raised. If desired, a finger recess may be provided in the top surface of the panel for use as a handle to raise it in use, and this recess may if desired receive the latch or bolt of the frame when the panel is raised flush with the frame and ceiling.

This invention is illustrated in the drawings of which:

FIG. 11A is a section similar to that of FIG. 11 but showing one panel lowered slightly from the horizontal position;

Figure 1:
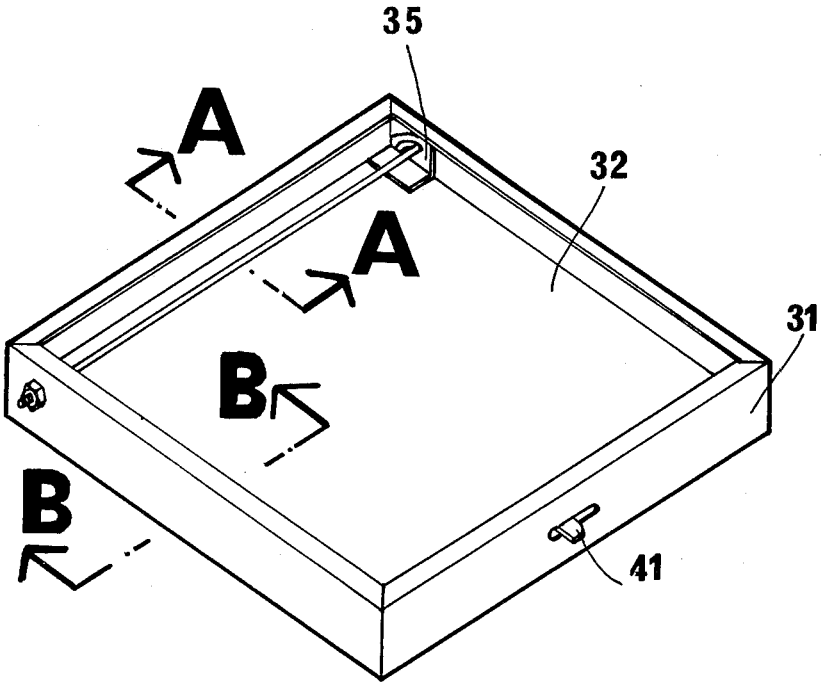
FIG. 1 is a perspective view from above of an access panel assembly according to this invention.
Figure 2:
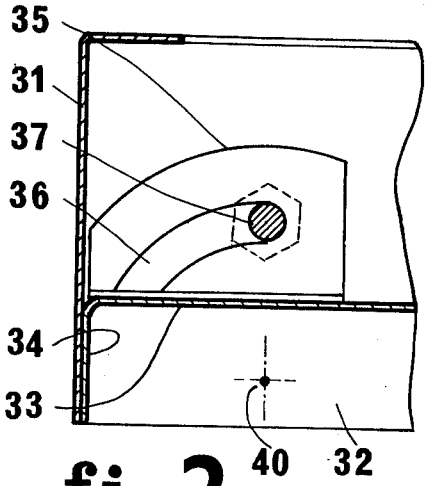
FIG. 2 is a partial section taken along the line A—A of FIG. 1.
Figure 3:
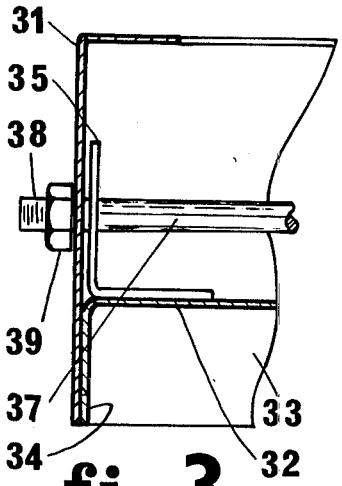
FIG. 3 is a partial section taken along the line B—B of FIG. 1.

The assembly shown in FIGS. 1 to 3 of the drawings comprises an outer frame 31 in which is closely received an access panel 32. The panel 32 comprises a top surface 33 of sheet metal and a depending metal skirt 34 which in use protects the edges of tiles (not shown) supported by the panel. Above the top surface 33 are spot welded two brackets 35, one at each side of the panel 32. Each bracket 35 has formed therein an arcuate slot 36 which receives a pivot bar 37. The pivot bar 37 is screw-threaded at its end portions 38 and passes completely through opposite side walls of the outer frame 31 where it is retained by nuts 39.

Each arcuate slot 36 has its centre on an axis 40 immediately below the pivot bar 37 and mid-way of the metal skirt 34. The panel 32 can thus be moved downwardly from its raised position shown in the drawings to an access position by a combination of sliding and pivoting movements of the slot 36 and pivot bar 37. This has the effect of net pivotal movement of the panel around the axis 40.

The portion of the slot 36 which receives the bar 37 when the panel 32 is in its raised position is horizontal, so that the weight of the panel acts normally to the slot.

A rotary bolt 41 (FIG. 1) is provided for securing the panel 32 in its raised position.

The reference numerals of FIGS. 4 to 13 form a different sequence of numbers from those of FIGS. 1 to 3.

Figure 4:
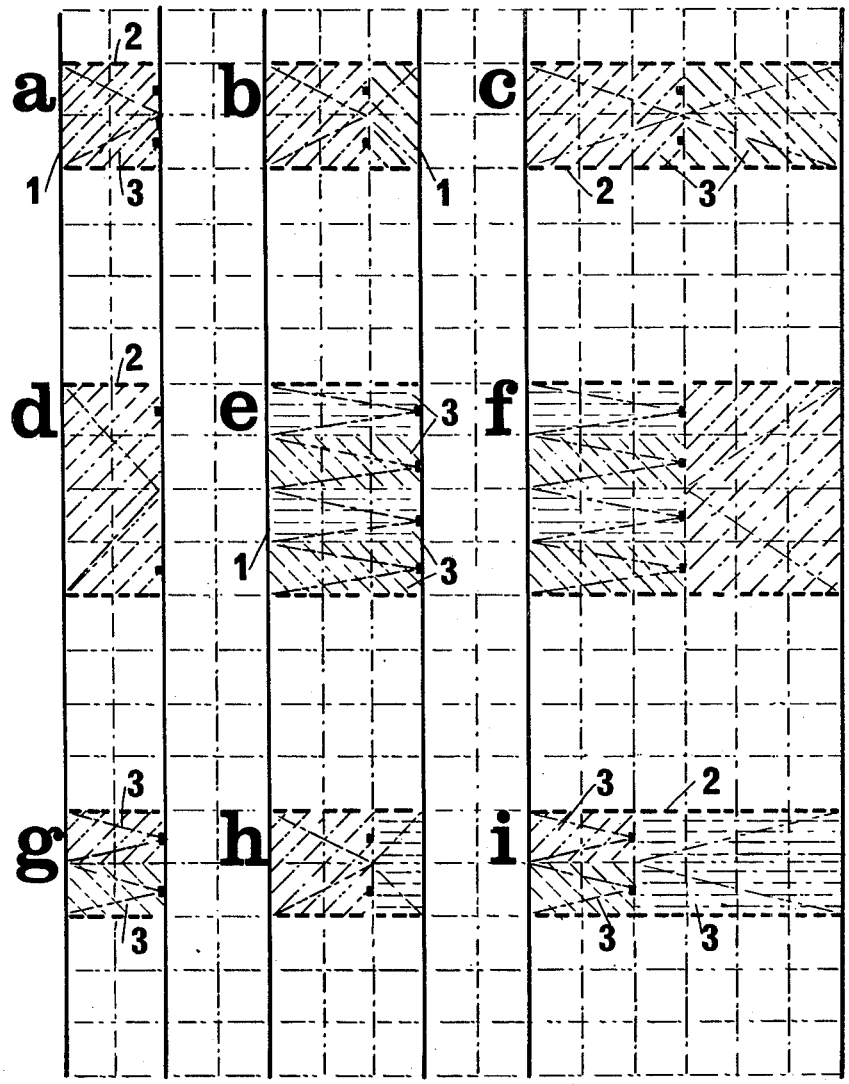
FIG. 4 is a plan view of a suspended ceiling showing nine different access panel assemblies all according to the invention.

In FIG. 4 there are shown, as a to i, nine different assemblies according to the invention. Each comprises a metal outer frame made up of longitudinal and transverse members 1 and 2, around one or more access panels 3. The members 1 and 2 are both cold rolled metal sections. In assemblies a, d, e and g the panels are pivoted about only one longitudinal edge member 1 of the frame, whereas in assemblies b, c, f, h and i cooperating panels are pivoted about opposite edge members 1 of the frame so that they meet together to fill the opening.

Figure 5:
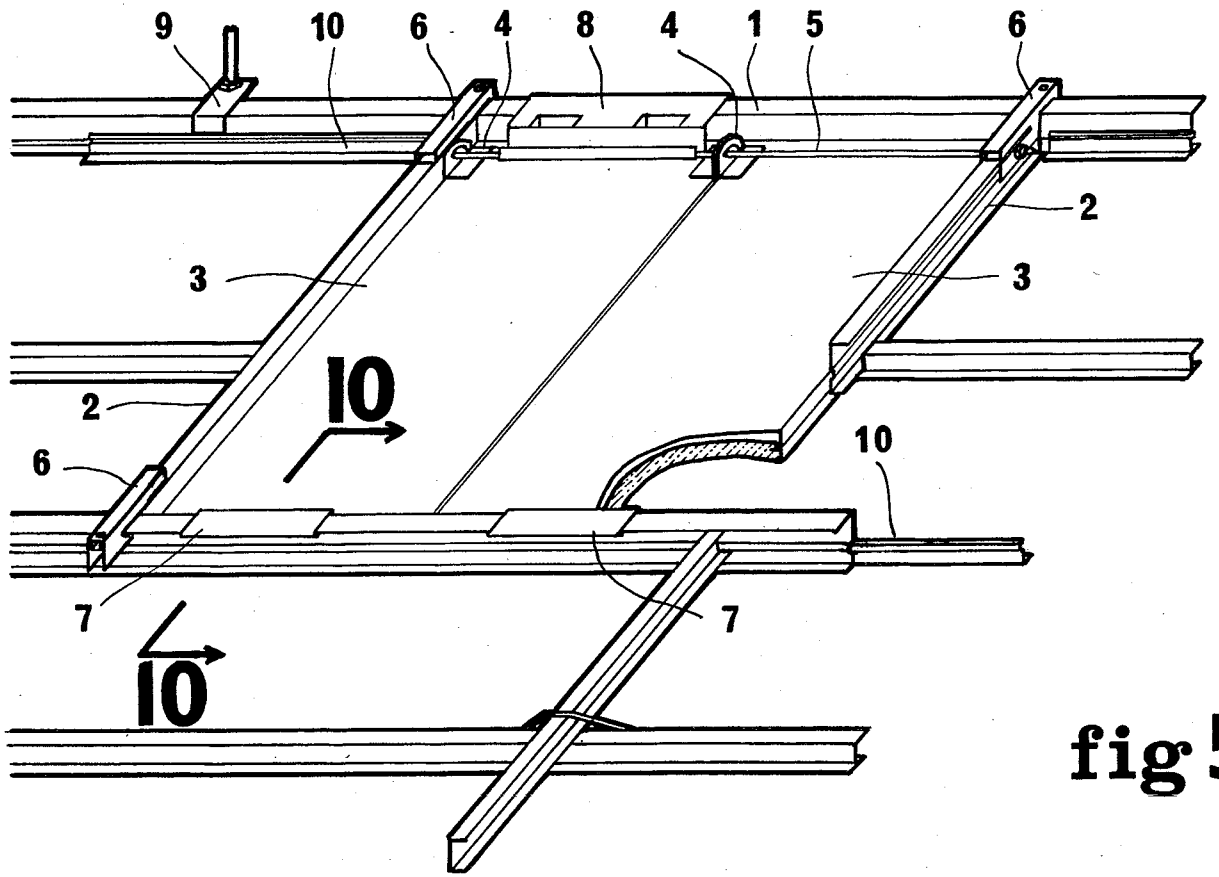
FIGS. 5, 6 and 7 are perspective views from above of the assemblies marked g, a and i respectively of FIG. 4.

FIG. 5 shows in more detail construction of assembly g of FIG. 4. The frame surrounds two panels 3 which are mounted by means of brackets 4 each having an arcuate slot therein through which passes a rod 5 passing through and secured at its ends to the transverse sections 2 of the frame.

A corner reinforcement 6 is provided both to provide a corner joint for the frame and to reinforce the anchorage of the bar 5.

Figure 10:
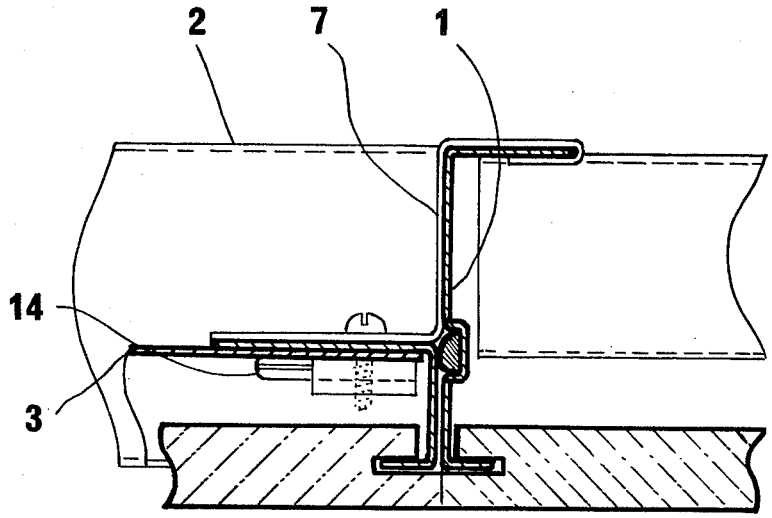
FIG. 10 is a vertical section taken along the line 10—10 of FIG. 5.
Figure 11:
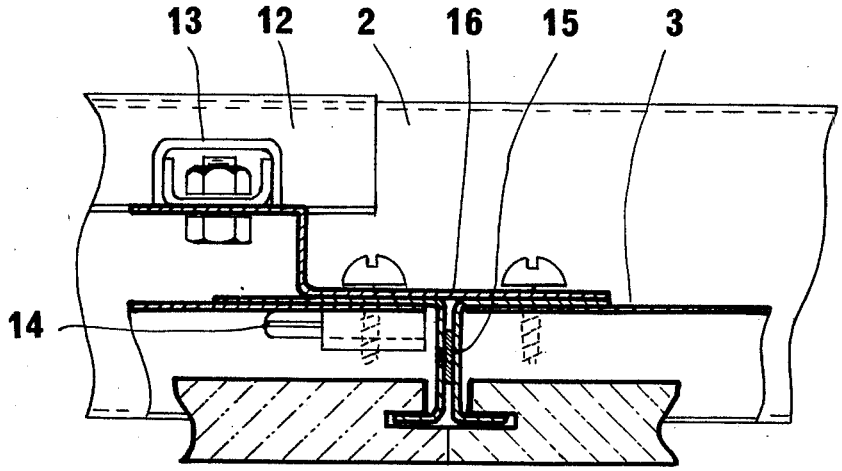
FIG. 11 is a vertical section taken along the line 11—11 of FIG. 7.

Two lock assemblies 7 are mounted on the longitudinal frame member 1 opposite to the pivot rod 5, and incorporate budget locks 14 as shown in FIG. 10. These locks 14 are in all material respects identical to the lock 14 of FIGS. 11 and 11A which is described in greater detail below.

Intermediate its ends, the rod 5 is supported by means of a bracket 8 clipped over the top of the longitudinal frame member 1 adjacent the rod. This prevents sagging of the rod 5, and enables continuous lengths of adjacent access panels 3 to be pivoted around a continuous pivot rod as in the assembly e of FIG. 4.

The entire suspended ceiling is supported from above by rods and wires secured in suspension brackets 9. If desired the metal outer frame of the access panel assembly may be made in situ from longitudinal members 1 directly supported by the brackets 9 and spanning the entire length or width of the room, and shorter transverse members 2 which are the width of the access opening only and which are secured in place by the corner reinforcements 6. In such a ceiling system the longitudinal members 1 should also support flange members 10 for all of their length except that part where the access opening is required, so that the composite section provided by the members 1 and 10 has out turned flanges on both sides to engage in the kerfs of ceiling tiles of the suspended ceiling.

Figure 6:
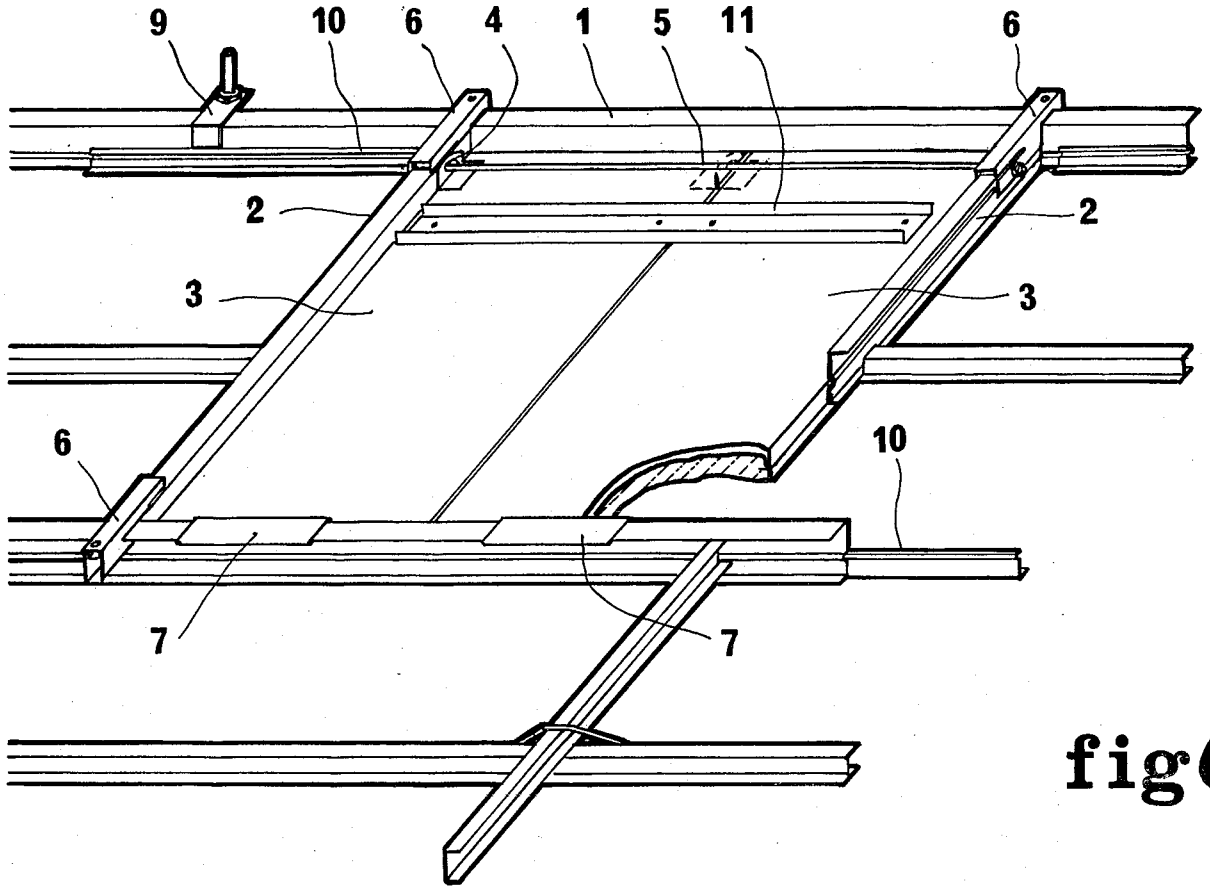

The access panel assembly shown in detail in FIG. 6 is in all material respects identical to that of FIG. 5 except that the two panels 3 have been joined together to form an integral unit by means of a tie bar 11. This enables the central two brackets 4 to be omitted, so that the composite panel is supported only at its outer edges adjacent the transverse members 2. Accordingly the bar support brackets 8 can be omitted.

Figure 7:
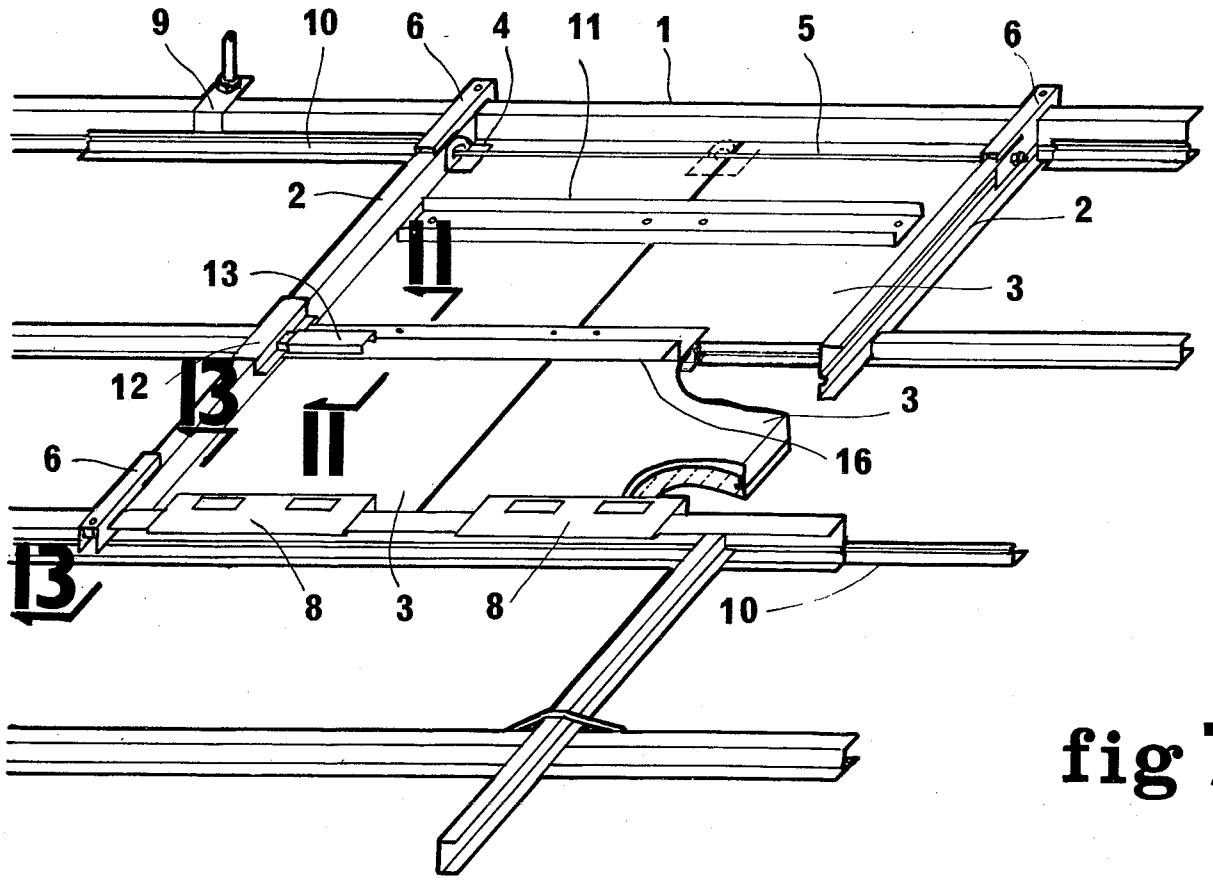
Figure 8:
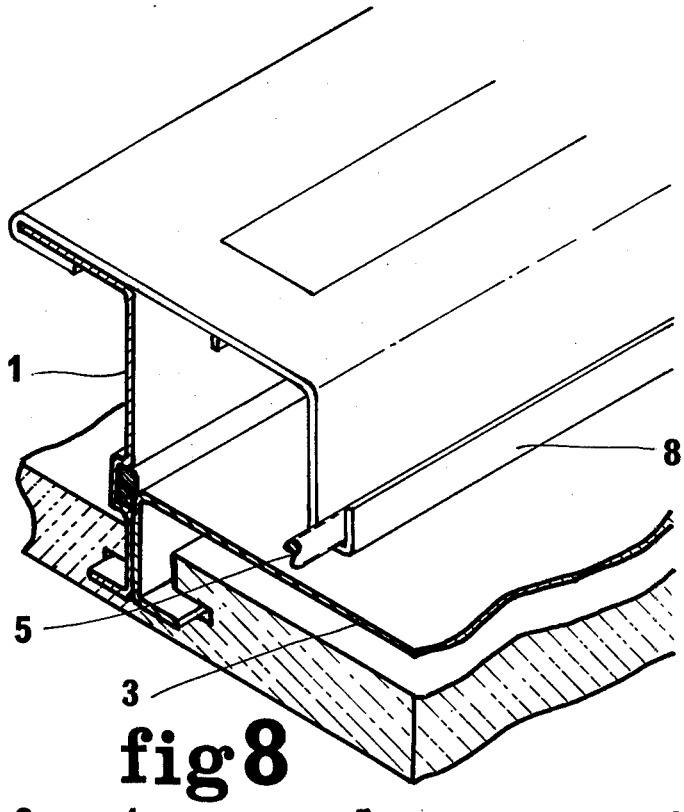
FIG. 8 is a sectional perspective view of a bar intermediate support of FIG. 5.
Figure 9:
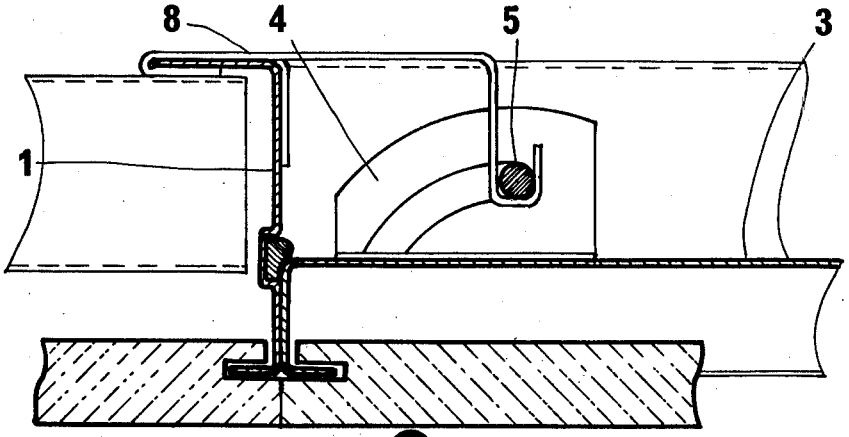
FIG. 9 is a vertical section taken in the same plane as the section of FIG. 8.

The access panel assembly of FIG. 7 shows how access panels 3 can be pivotally mounted adjacent each of the two longitudinal members 1 defining the outer frame. One pair of panels 3 is shown in FIG. 7 as being connected by a tie bar 11, and the panels 3 of the opposite pair are individually pivotable as in FIG. 5. Along the edge of the first-mentioned pair of panels 3 remote from the rod 5 is a locating flange 16 which mounts a pair of budget locks 14 and accurately locates the upper surfaces of the individually pivotable panels 3 when these are in their raised positions. The flange 16 also mounts at its ends bolts 13 each of which can be slid into engagement with a flange 12 mounted on a transverse member 2. To lock the panels of this embodiment in their closed position, the two panels 3 that are tied together by the tie bar 11 are first raised to the position shown and the bolts 13 engaged with the flanges 12. Each of the remaining individually pivotable panels 3 can then be raised in turn, until its upper surface abuts the flange 16 and a lock 14 supported on the flange 16 is received in an aperture 20 (FIG. 11A) in the upper surface of the panel 3. A key is then used to extend the bolt of the lock 14 through an aperture 21 in a leading edge of the panel 3.

It will be understood that the lock 14 of FIG. 10 is mounted and operates in an entirely analogous manner, save that it is mounted on the flange member 7 rather than the flange member 16.

Figure 12:
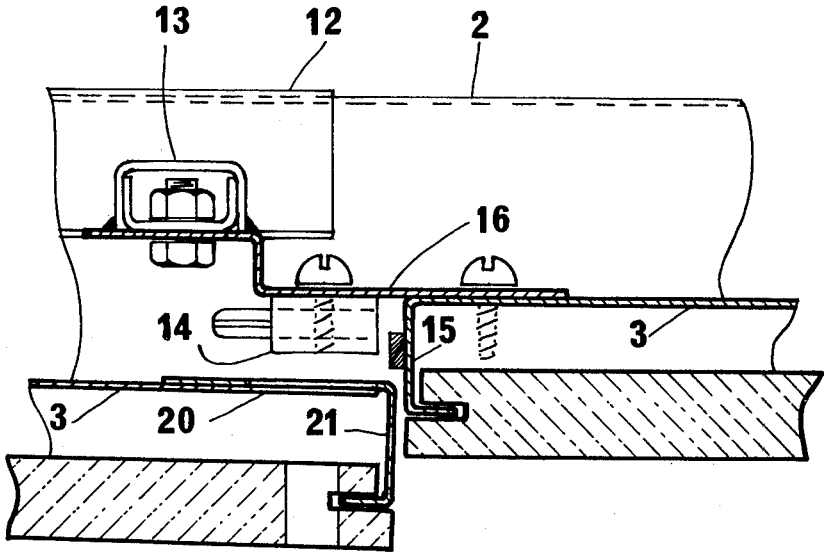
FIG. 12 is a vertical section taken along the line 12—12 of FIG. 13.
Figure 13:
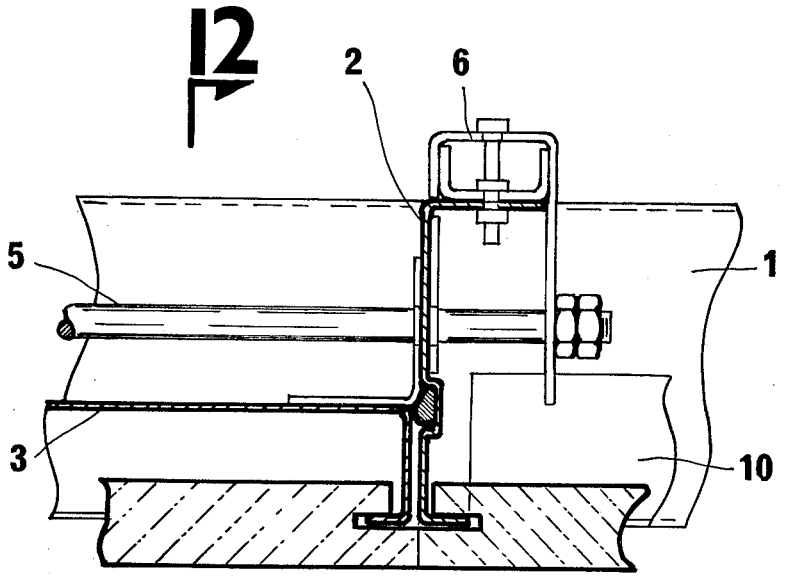
FIG. 13 is a vertical section taken along the line 13—13 of FIG. 7.
Figure 12:
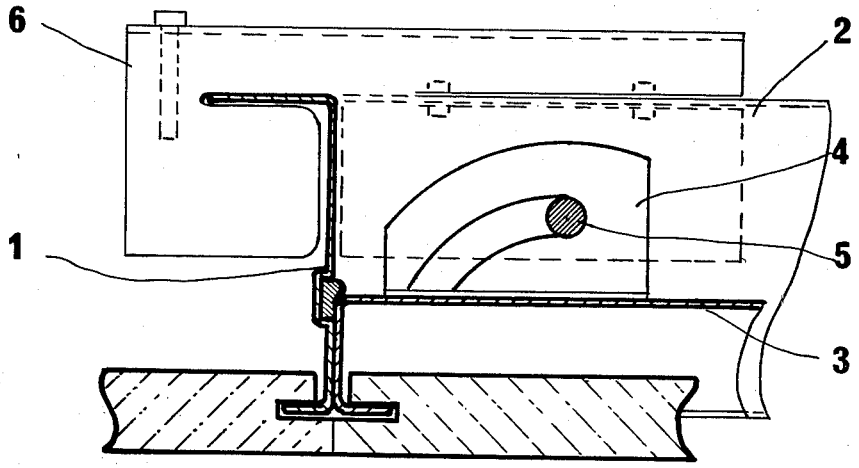

FIGS. 12 and 13 illustrate the pivotable mounting of the panels 3. In every case the rod 5 passes through an arcuate slot in a bracket 4 upstanding from the upper surface of the panel 3. It will be observed in FIG. 13 that the bracket 4 is in close abutment with the transverse member 2, which provides for smooth movement of the panel as it is moved from its raised position to its lowered, access position. Furthermore, there is a slight space between the edges of the panel 3 and the transverse members 2, and there is therefore provided a resilient gasket 22 all around the opening so that the flow of air from the room to the space above the suspended ceiling or vice-versa is reduced to a minimum, avoiding the accumulation of dust around the opening.

It will be appreciated that the access panel assemblies illustrated in FIGS. 4 to 13 are for use in a concealed Z-bar suspended ceiling system. In the ceiling proper, kerfed tiles are supported by means of Z-section bars the flanges of which are received in the kerf of the tiles so as to enable the tiles to lie in close abutment to present an unbroken ceiling finish when viewed from below. Because the depending metal skirt of the panels 3 terminates in a similar inturned flange, the kerfed tiles mounted on the access panels of such assemblies can be brought into close abutment with the tiles of the remainder of the ceiling as shown in FIG. 10, so that the only visible indication of the location of the access opening is the small key hole necessary to gain access to the budget lock 14.

One advantage of the construction of FIGS. 4 to 13 is that the access panels 3 can be fitted in position during initial installation of the grid system for the suspended ceiling, and then removed while further contractural work takes place on the building. The fitting of ceiling tiles into the grid system can then be carried out at a later stage, and the access panel fitted only when all other contractural work is complete. In this way the possibility of damage to the tiles in the access panel is minimized.

To fit the tiles in the access panels 3 of FIGS. 4 to 13, the leading edge 23 (FIG. 10) of each panel 3 is removed and the tiles slid into place. If appropriate, T-sections can be supported across the panels to locate in kerfs of adjacent tiles. When all the tiles have been fed into the panel 3, the flange 23 is replaced and secured by screws.

If desired, the space between the tiles and the top surface of the panel 3 may be filled by insulating material.

I claim:

1. An access panel assembly for a ceiling, comprising a metal outer frame around at least one access panel which has a depending metal skirt around the edge thereof and which fits flush in the opening defined by the frame, a pivot rod mounted securely on the frame above the panel or panels above and parallel to, but laterally spaced from, an adjacent edge of the panel or panels, and at least two upstanding brackets on each panel, each having a guide slot therein for receiving the pivot rod, wherein each guide slot extends from a generally horizontal first end portion for receiving the rod when the access panel is raised, to a second end portion nearer the adjacent edge of the associated access panel.

2. An assembly according to claim 1, wherein the frame is around more than one access panel.

3. An assembly according to claim 2, wherein the access panels are pivoted about the same side of the outer frame.

4. An assembly according to claim 2, wherein the access panels are pivoted about opposite parallel sides of the outer frame.

5. An assembly according to claim 1, wherein the pivot rod is a rod extending the whole length or width of the outer frame and secured at its ends by nuts.

6. An assembly according to claim 5, wherein each guide slot comprises a generally horizontal portion for receiving its pivot rod when the associated access panel is in its raised position and a portion extending downwardly and towards the adjacent side of the access panel for receiving its pivot rod as the access panel is lowered to its access position.

7. An assembly according to claim 6, wherein each guide slot is arcuate or approximately arcuate, centring about a common axis that is immediately beneath the axis of the pivot rod or rods and adjacent a lower surface of the access panel.

8. An assembly according to claim 1, wherein the metal skirt of the access panel is provided around its lower edge with an inturned flange for engaging kerfs of one or more ceiling tiles to mount the tiles beneath the access panel.

9. An assembly according to claim 8, wherein the metal skirt and flange along one side of the access panel is detachable.

10. An assembly according to claim 8, wherein the lower edge of the outer frame is provided with an outturned flange for engaging kerfs of ceiling tiles.

11. An assembly according to claim 8, having a gasket seal between the outer frame and the access panel.

* * * * *